US006613147B1

(12) United States Patent
Nieto

(10) Patent No.: US 6,613,147 B1
(45) Date of Patent: Sep. 2, 2003

(54) PORTABLE SPRAY BOOTH

(76) Inventor: Jesse L. Nieto, P.O. Box 6581, Avon, CO (US) 81620

( * ) Notice: Subject to any disclaimer, the term of this patent is extended or adjusted under 35 U.S.C. 154(b) by 54 days.

(21) Appl. No.: 09/904,722

(22) Filed: Jul. 13, 2001

(51) Int. Cl.[7] ..... B05B 15/12

(52) U.S. Cl. ..... 118/326; 118/305; 118/315; 118/316; 427/424

(58) Field of Search ..... 118/326, 305, 118/315, 316, 313; 427/424

(56) References Cited

U.S. PATENT DOCUMENTS 2,332,385 A * 10/1943 Lauring ..... 118/63
2,347,728 A 5/1944 Bell
3,904,431 A 9/1975 Dinerman
4,174,678 A 11/1979 Van Den Bergh
4,924,801 A 5/1990 Arnone
5,549,753 A * 8/1996 Matthews et al. ..... 118/316
5,591,240 A * 1/1997 Ophardt et al. ..... 96/407
5,597,414 A 1/1997 Potthoff
5,647,906 A * 7/1997 Monday et al. ..... 118/70
5,669,974 A * 9/1997 Cueller et al. ..... 118/686
5,893,515 A 4/1999 Hahn et al.

* cited by examiner

*Primary Examiner*—Richard Crispino
*Assistant Examiner*—Michelle A Lazor

(57) ABSTRACT

A portable spray booth for applying paint to plank-like members. The portable spray booth includes a housing having a top wall, a bottom wall, a front wall, a back wall and a pair of lateral side walls. The front and back walls each has an opening therein. The openings in the front and back walls are aligned and are positioned generally between the top and bottom walls. A delivery pipe is positioned in the housing and extends around an interior of the housing. A plurality of nozzles is fluidly coupled to the delivery pipe. An inlet pipe is fluidly coupled to the delivery pipe and extends through one of the lateral side walls. A pump is fluidly coupled to a container for pumping paint out of the container. The pump is in communication with the delivery pipe.

1 Claim, 4 Drawing Sheets

PORTABLE SPRAY BOOTH

BACKGROUND OF THE INVENTION

1. Field of the Invention

The present invention relates to paint application devices and more particularly pertains to a new portable spray booth for applying paint to plank-like members.

2. Description of the Prior Art

The use of paint application devices is known in the prior art. More specifically, paint application devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,924,801; 3,904,431; 2,347,728; 5,597,414; 4,174,678; and 5,893,515.

While these devices fulfill their respective, particular objectives and requirements, the aforementioned patents do not disclose a new portable spray booth. The inventive device includes a housing having a top wall, a bottom wall, a front wall, a back wall and a pair of lateral side walls. The front and back walls each has an opening therein. The openings in the front and back walls are aligned and are positioned generally between the top and bottom walls. A delivery pipe is positioned in the housing and extends around an interior of the housing. A plurality of nozzles is fluidly coupled to the delivery pipe. An inlet pipe is fluidly coupled to the delivery pipe and extends through one of the lateral side walls. A pump is fluidly coupled to a container for pumping paint out of the container. The pump is in communication with the delivery pipe.

In these respects, the portable spray booth according to the present invention substantially departs from the conventional concepts and designs of the prior art, and in so doing provides an apparatus primarily developed for the purpose of applying paint to plank like members.

SUMMARY OF THE INVENTION

In view of the foregoing disadvantages inherent in the known types of paint application devices now present in the prior art, the present invention provides a new portable spray booth construction wherein the same can be utilized for applying paint to plank like members.

The general purpose of the present invention, which will be described subsequently in greater detail, is to provide a new portable spray booth apparatus and method which has many of the advantages of the paint application devices mentioned heretofore and many novel features that result in a new portable spray booth which is not anticipated, rendered obvious, suggested, or even implied by any of the prior art paint application devices, either alone or in any combination thereof.

To attain this, the present invention generally comprises a housing having a top wall, a bottom wall, a front wall, a back wall and a pair of lateral side walls. The front and back walls each has an opening therein. The openings in the front and back walls are aligned and are positioned generally between the top and bottom walls. A delivery pipe is positioned in the housing and extends around an interior of the housing. A plurality of nozzles is fluidly coupled to the delivery pipe. An inlet pipe is fluidly coupled to the delivery pipe and extends through one of the lateral side walls. A pump is fluidly coupled to a container for pumping paint out of the container. The pump is in communication with the delivery pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable spray booth apparatus and method which has many of the advantages of the paint application devices mentioned heretofore and many novel features that result in a new portable spray booth which is not anticipated, rendered obvious, suggested, or even implied by any of the prior art paint application devices, either alone or in any combination thereof.

It is another object of the present invention to provide a new portable spray booth which may be easily and efficiently manufactured and marketed.

It is a further object of the present invention to provide a new portable spray booth which is of a durable and reliable construction.

An even further object of the present invention is to provide a new portable spray booth which is susceptible of a low cost of manufacture with regard to both materials and labor, and which accordingly is then susceptible of low prices of sale to the consuming public, thereby making such portable spray booth economically available to the buying public.

Still yet another object of the present invention is to provide a new portable spray booth which provides in the apparatuses and methods of the prior art some of the advantages thereof, while simultaneously overcoming some of the disadvantages normally associated therewith.

Still another object of the present invention is to provide a new portable spray booth for applying paint to plank like members.

Yet another object of the present invention is to provide a new portable spray booth which includes a housing having a top wall, a bottom wall, a front wall, a back wall and a pair of lateral side walls. The front and back walls each has an opening therein. The openings in the front and back walls are aligned and are positioned generally between the top and bottom walls. A delivery pipe is positioned in the housing and extends around an interior of the housing. A plurality of nozzles is fluidly coupled to the delivery pipe. An inlet pipe is fluidly coupled to the delivery pipe and extends through one of the lateral side walls. A pump is fluidly coupled to a container for pumping paint out of the container. The pump is in communication with the delivery pipe.

Still yet another object of the present invention is to provide a new portable spray booth that may be taken within a dwelling for applying paint to multiple planks in an efficient manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
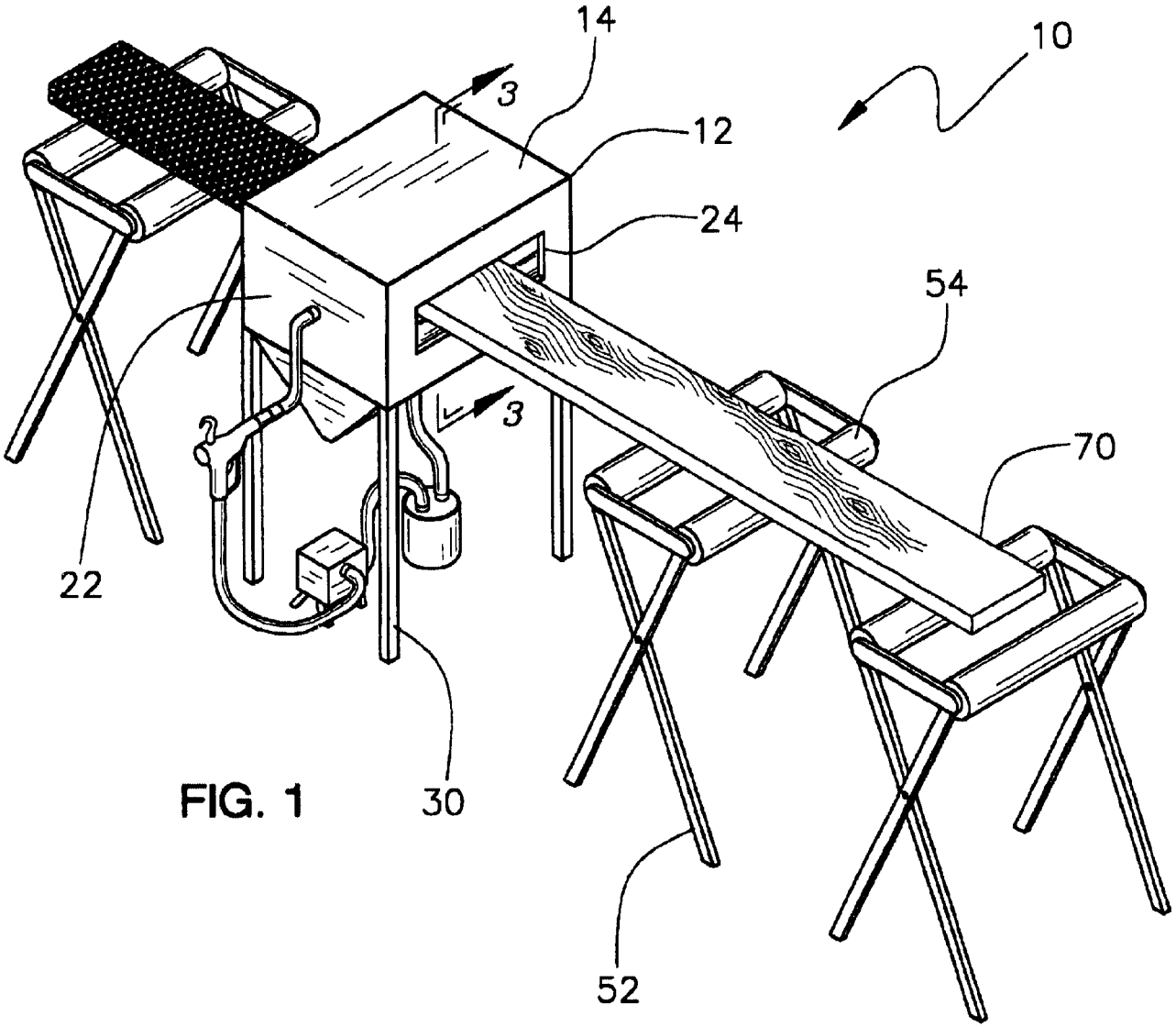
FIG. 1 is a schematic perspective view of a new portable spray booth according to the present invention.
Figure 2:
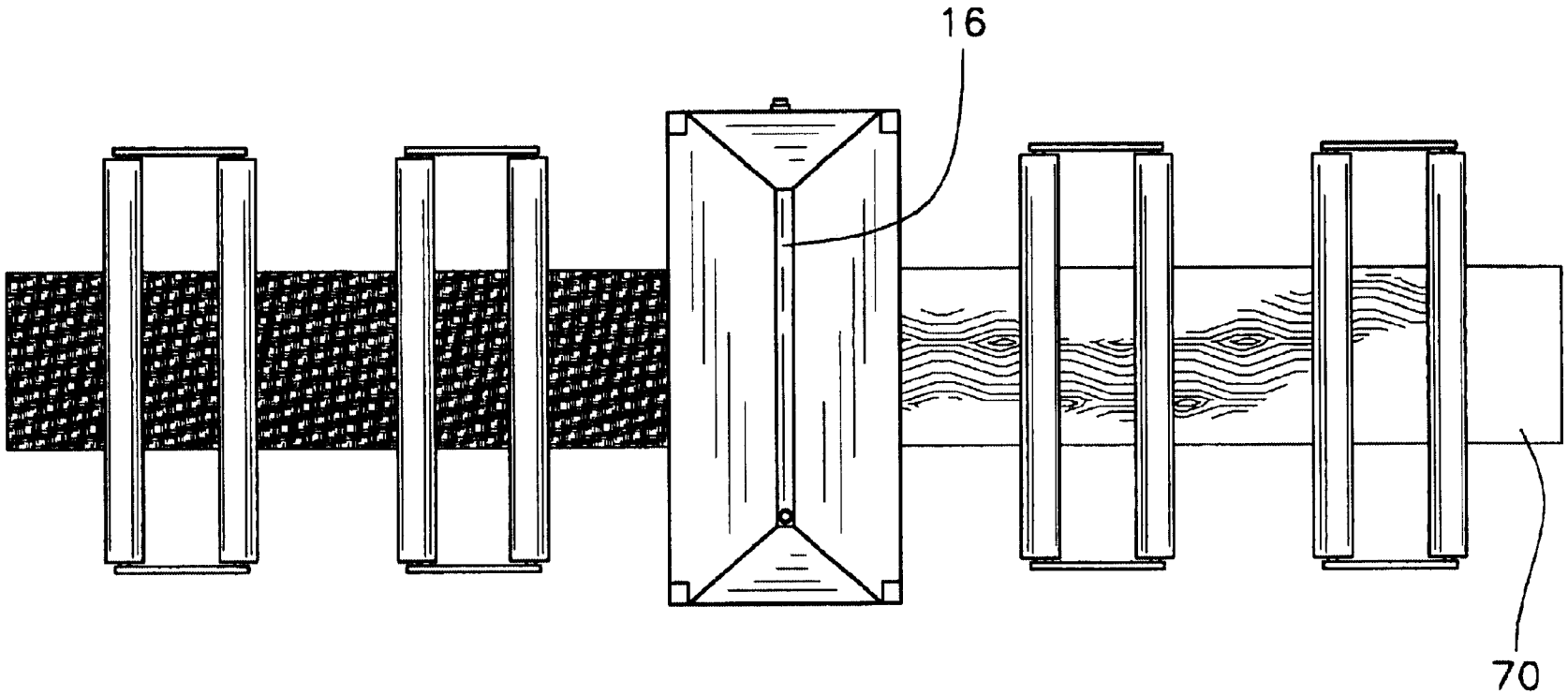
FIG. 2 is a schematic bottom view of the present invention.
Figure 3:
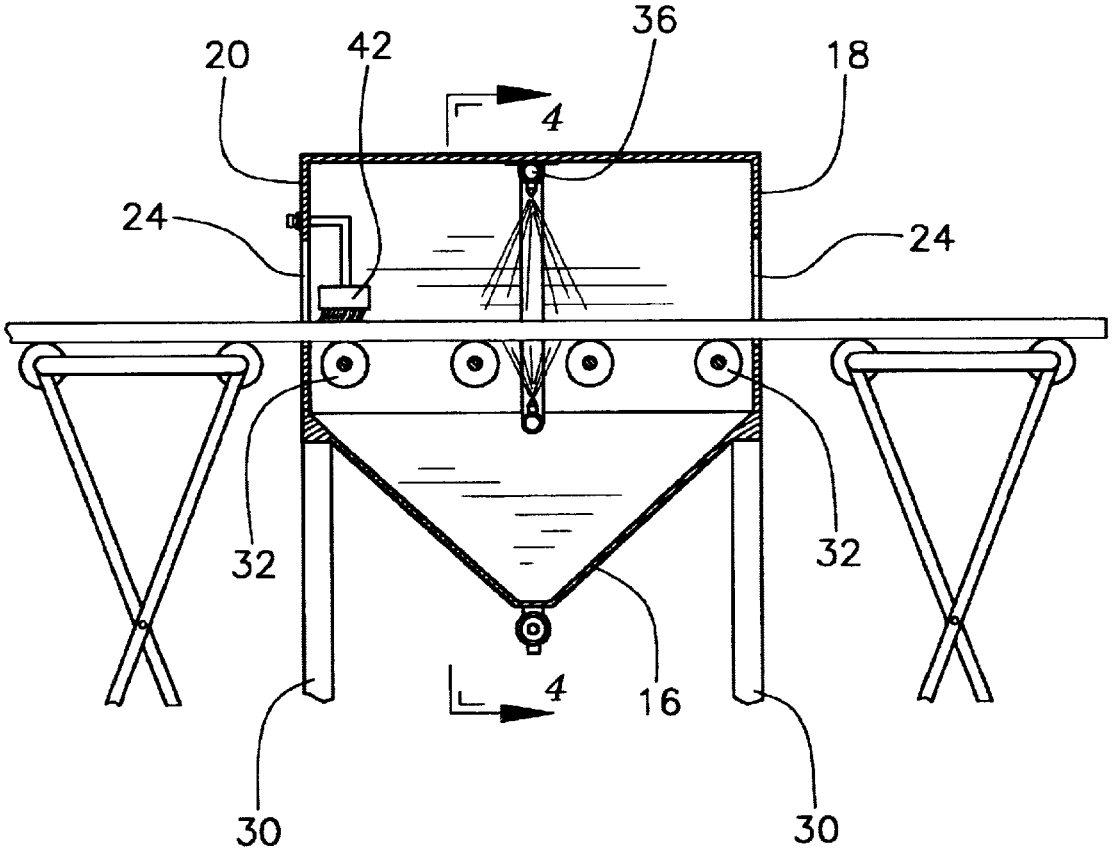
FIG. 3 is a schematic cross-sectional view taken along line 3—3 of FIG. 1 of the present invention.
Figure 4:
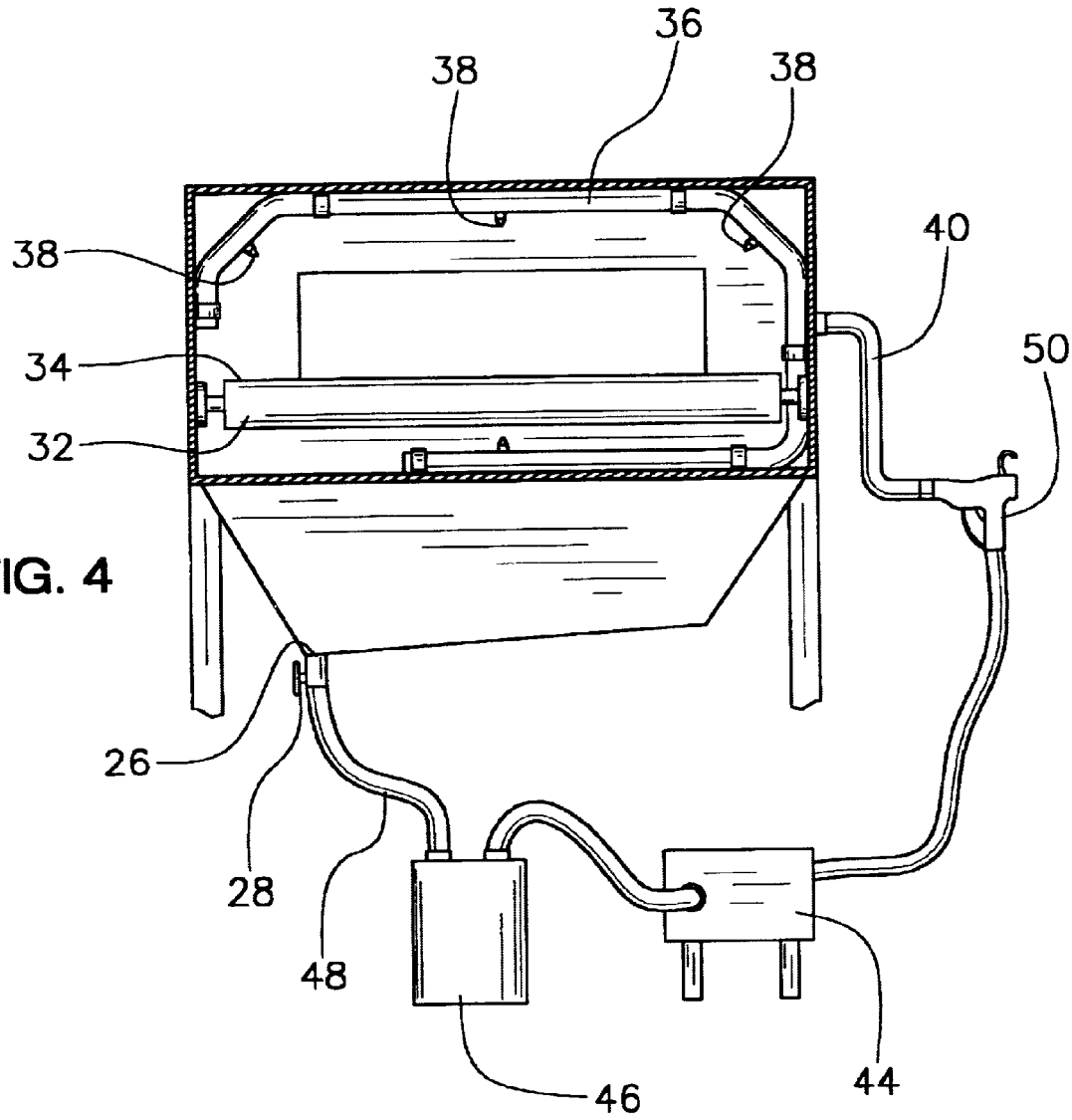
FIG. 4 is a schematic cross-sectional view taken along line 4—4 of FIG. 3 of the present invention.

With reference now to the drawings, and in particular to FIGS. 1 through 4 thereof, a new portable spray booth embodying the principles and concepts of the present invention and generally designated by the reference numeral 10 will be described.

As best illustrated in FIGS. 1 through 4, the portable spray booth 10 generally comprises a device for spraying paint, or other pre-finish material, on elongated members 70 such as planks. The device comprises a housing 12 having a top wall 14, a bottom wall 16, a front wall 18, a back wall 20 and a pair of lateral side walls 22. The front 18 and back 20 walls each have an opening 24 therein. The openings 24 in the front 18 and back 20 walls are aligned and are positioned generally between the top 14 and bottom 16 walls. The bottom wall 16 forms a trough having a lowest point 26. A valve 28 is in communication with the housing 12 and is coupled to the lowest point 28. The valve 28 may be open to drain the trough. The bottom wall 16 has a plurality of legs 30 attached thereto.

A plurality of roller members 32 is rotatably mounted in the housing 12. Each of the roller members 32 extends between the lateral side walls 22 and each has a rotational axis orientated perpendicular to a plane of the lateral side walls 22. The roller members 32 have a highest edge 34 positioned above a bottom edge of the openings 24 such that the elongated member 70 may ride on the rollers through the openings 24.

A delivery pipe 36 is positioned in the housing 12 and extends around an interior of the housing 12 such that the delivery pipe 36 is adjacent to the bottom 16, top 14 and lateral side 22 walls. A plurality of nozzles 38 is fluidly coupled to the delivery pipe 36. The nozzles 36 are directed toward a central area of the housing 12. Ideally the delivery pipe 36 is rotatably mounted in the housing 12 for changing the angle of spray of the paint. An inlet pipe 40 is fluidly coupled to the delivery pipe 36 and extends through one of the lateral side walls 22.

Also preferably included is a brush 42 adjustably mounted in the housing 12 and extending downward partially over the opening 24 in the back wall 20 for spreading the paint on the elongated member 70.

A pump 44 is fluidly coupled to a container 46 for pumping paint out of the container 46. The pump 44 is in communication with the inlet pipe 40. An actuator 50 is operationally coupled to the pump 44 for selectively pumping paint into the inlet pipe 40. A drain hose 48 is fluidly coupled to and extending between the valve 28 and the container 46. The pump 44 and actuator 50 may be a conventional paint sprayer which may be fluidly coupled to the inlet pipe 40.

A plurality of racks 52 has an upper surface with a plurality of rollers 54 thereon. The rollers 54 have a height generally equal to the roller members 32. The racks 52 are used for supporting the elongated member 70.

In use, paint is pumped into the delivery pipe 40 so that the paint sprays out of the nozzles 38 and onto the elongated member 70. This allows a person to quickly place finish or paint planks, molding or other coverings before mounting them on a wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable paint spray booth device for spraying paint on elongated members, said device comprising:

a housing having a top wall, a bottom wall, a front wall, a back wall and a pair of lateral side walls, said front and back walls each having an opening therein, said openings in said front and back walls being aligned and being positioned generally between said top and bottom walls, said bottom wall forming a trough having a lowest point, a valve being in communication with said housing and being coupled to said lowest point, said bottom wall having a plurality of legs attached thereto;

a plurality of roller members being rotatably mounted in said housing, each of said roller members extending between said lateral side walls and having a rotational axis orientated perpendicular to said lateral side walls, each of said roller members having a highest edge positioned above a bottom edge of said openings such that the elongated member rides on said rollers through said openings;

a delivery pipe being positioned in said housing, said delivery pipe extending around an interior of said housing such that said delivery pipe is adjacent to said bottom, top and lateral side walls, a plurality of nozzles being fluidly coupled to said delivery pipe, said nozzles being directed toward a central area of said housing;

an inlet pipe being fluidly coupled to said delivery pipe and extending through one of said lateral side walls;

a pump being fluidly coupled to a container for pumping paint out of said container, said pump being in communication with said inlet pipe;

an actuator being operationally coupled to said pump for selectively pumping paint into said inlet pipe;

a drain hose being fluidly coupled to and extending between said valve and said container; and a plurality of racks having an upper surface with a plurality of rollers thereon, said rollers having a height generally equal to said roller members.

* * * * *